US011834261B2

(12) United States Patent
Brown et al.

(10) Patent No.: US 11,834,261 B2
(45) Date of Patent: Dec. 5, 2023

(54) MATERIALS MANAGEMENT BAG AND SYSTEM AND METHOD FOR TRACKING

(71) Applicants: Kristen Brown, Pawleys Island, SC (US); Mark Dancy, Murrells Inlet, SC (US); Steve Lisauskas, Andover, MA (US)

(72) Inventors: Kristen Brown, Pawleys Island, SC (US); Mark Dancy, Murrells Inlet, SC (US); Steve Lisauskas, Andover, MA (US)

(73) Assignee: WasteZero, Inc., Murrells Inlet, SC (US)

( * ) Notice: Subject to any disclaimer, the term of this patent is extended or adjusted under 35 U.S.C. 154(b) by 0 days.

(21) Appl. No.: 17/739,774

(22) Filed: May 9, 2022

(65) Prior Publication Data

US 2022/0356012 A1 Nov. 10, 2022

Related U.S. Application Data

(60) Provisional application No. 63/185,797, filed on May 7, 2021.

(51) Int. Cl.

| | |
|---|---|
| ***B65F 1/14*** | (2006.01) |
| ***B65H 29/00*** | (2006.01) |
| ***B31B 70/88*** | (2017.01) |
| *B31B 160/10* | (2017.01) |

(52) U.S. Cl.

CPC ..... *B65F 1/1484* (2013.01); *B31B 70/88* (2017.08); *B65H 29/006* (2013.01); *B31B 2160/10* (2017.08); *B65F 2210/112* (2013.01); *B65F 2210/138* (2013.01); *B65F 2250/114* (2013.01); *B65H 2301/4193* (2013.01); *B65H 2701/191* (2013.01)

(58) Field of Classification Search

None

See application file for complete search history.

(56) References Cited

FOREIGN PATENT DOCUMENTS

| | | | | |
|---|---|---|---|---|
| CN | 111907966 A | * | 11/2020 | |
| EP | 2732961 A1 | * | 5/2014 | ..... B65D 33/004 |

* cited by examiner

*Primary Examiner* — Hemant Desai
*Assistant Examiner* — Tanzim Imam

(57) ABSTRACT

A computer-managed database of interconnected, unique codes attached on trash, recycling and other material management or recovery bags enables program managers to track and measure the materials management behavior including but not limited to weight, composition, compliance, and fraud; and to provide feedback including education, penalties or incentives directly to affected persons in order to cost effectively meet federal, state, local or corporate goals.

14 Claims, 9 Drawing Sheets

MATERIALS MANAGEMENT BAG AND SYSTEM AND METHOD FOR TRACKING

CROSS-REFERENCE TO RELATED APPLICATIONS

This application claims priority under 35 U.S.C. 119(e) from U.S. Provisional Patent Application No. 63/185,797, filed on May 7, 2021, which is hereby incorporated by reference herein in its entirety.

FIELD OF THE INVENTION

This disclosure pertains to a system and method for manufacturing and tracking materials management bags, and more particularly, to a system and method for manufacturing, individually coding and tracking materials management bags in association with one or more of a common entity ("generator") and/or geographic location.

BACKGROUND

According to the United States Environmental Protection Agency, 42% of all greenhouse gasses (GHGs)—the emissions driving global climate change—are related to materials management. GHG reduction goals, including through waste diversion, have become an integral part of governmental and corporate climate change reduction efforts.

Municipal governments and corporations have been working to reduce waste over the past several decades with limited success. There are state and local goals, mandatory recycling laws, as well as waste bans that forbid the disposal of certain materials, but there is no practicable way to monitor compliance or enforce these laws. Thus, there is a need for solutions that assist in reducing waste and ensuring compliance with existing and future laws related to recycling and waste management while maximizing the value governments, corporations and non-profit entities receive for materials recovered via recycling and reuse.

Recycling and reuse industry growth relies on the existence of clean and steady material feedstock streams. Recycling and material recovery programs have plateaued, however, and, at the same time existing streams of material have become more contaminated. The high and increasing levels of contamination in these programs have created costly obstacles for recyclers and recycling-related entities. These costs are passed on to taxpayers or consumers but are avoidable with the additional materials oversight, insight, and intelligence enabled by this invention.

To address these costs, some propose extended producer responsibility (EPR) policies that apply a tax on manufacturers to pay for the cost of recycling their material. EPR alone will not significantly reduce trash generation or increase materials recovery, quality or value.

There are thousands of materials management programs in the United States that currently require the use of special bags, including Pay As You Throw (PAYT) trash disposal programs, recycling programs, food waste collection programs, standard municipal bag programs, and others. The number of these programs continue to increase each year.

Education programs on their own have not and will not be enough to meet recycling goals. Indeed, education programs have been in place for decades and yet we still experience the growing problem of contamination in recycling, compost and other materials diversion programs. It is generally understood that approximately 10% of people recycle extremely well, 10% of people don't recycle at all, and 80% of people recycle sometimes. This 80% often has a general understanding of recycling and diversion program guidelines, but program education and enforcement for these 80% of residents is costly. Associated expenses are often cost-prohibitive. When it is done, enforcement typically consists of a person walking up and down the street looking in trash, recycling and compost bins for non-compliant items, and then attaching a piece of literature to a cart and hoping a resident pays attention to it. This ineffective system is not scalable to meet the extent of the challenge, and it is not sustainable long-terra.

A better understanding of specific entity ("generator") behaviors would benefit from a tool that can provide regular information about generation as well as targeted intervention to specific generators. This is a critical next step to advance diversion efforts and reduce GHG emissions. Automation in scanning and imaging—including the ability to see into a materials management bag and even determine the chemical composition of its contents—would be coupled with artificial intelligence techniques: at recycling facilities to determine what is in a bag. Knowledge of the contents of these bags together with the identities of the associated generators could enable waste and recycling professionals, at scale and low cost, to effectively educate, incentivize, or penalize generators based on their specific existing recycling behaviors.

SUMMARY

By way of example, aspects of the present disclosure are directed to system and method for manufacturing and tracking materials management bags.

In accordance with aspects of the present disclosure, a bag tracking tool enables a series of uniquely coded material management bags with codes that are linked to specific entities ("generators") to be tracked to improve recycling and material management, and make diversion program enforcement and education programs more cost effective and manageable. Generators within a specific program are required to use unique bags with codes for trash, recycling, compost, or other specified materials. The bags with codes are linked to a generator by those codes, and can be inspected in order to assist materials management program managers by providing information related to a specific generator's waste management behavior, including but not limited to weight, composition of materials, and program compliance. The tracking tool may facilitate a hands-free automatic communication channel directly to generators through mail, email or mobile system notification mechanisms; and provide detailed reports on individual and group behavior and trends so that program managers can maximize efficiency and success.

In accordance with additional aspects of the present disclosure, bag roll is disclosed for use in the material management program. The disclosed bag roll may include a plurality of bags formed from a flattened plastic film in continuous sequence and wound to form the bag roll. Each bag in the bag roll has at least one instance of an identifying code that is unique to that bag, and at least one instance of the identifying code is located at a position on each bag roll so that at least one identifying code of an outermost bag is visible on the bag roll.

In accordance with another aspect of the present disclosure, a bag is disclosed for inclusion in the bag roll, in which a plurality of instances of the identifying code are positioned along a fold line of the bag.

In accordance with other aspects of the disclosure, the identifying codes are presented as barcodes, matrix barcodes, QR codes, or chip codes, and represent numbers or alphanumeric strings that are either arranged in a sequence matching the sequence of the plurality of bags in the bag roll or are randomly assigned.

In accordance with further aspects of the disclosure, a method of making the bag roll is disclosed, including the steps of: a) forming a continuous sequence of bags for the bag roll from a flattened plastic film, b) communicating with a computer-based tool to obtain a plurality of unique identifying codes, each unique identifying code being associated with a respective one of the bags in the continuous sequence of bags, c) printing or affixing at least one instance of each identifying code to its respective bag, d) forming the bag roll from the continuous sequence of bags, e) scanning the unique identifying code of an outermost bag in the sequence of bags for the bag roll, and f) communicating the unique identifying code for the outermost bag to the computer-based tool. Once communicated, whereby the computer-based tool is operative to associate each of the plurality of unique identifying codes for all bags on a roll with the identifying code for the outermost bag.

In accordance with another aspect of the disclosure, the method includes the additional steps of: g) applying a wrapper to maintain the plurality of bags in the bag roll, h) placing the bag roll in a master packing case including at least one more bag roll that has a unique identifying code for a respective outermost bag, and i) communicating with the computer-based tool to provide the unique identifying codes for the outermost bags of the two or more bag rolls and obtain a master packing case code for the master packing case. The computer-based tool is then operative to associate the unique identifying codes for the outermost bags of the bag rolls (and, thereby, the identifying codes for the other bags in the bag rolls) with the master packing case code.

This SUMMARY is provided to briefly identify some aspects of the present disclosure that are further described below in the DESCRIPTION. This SUMMARY is not intended to identify key or essential features of the present disclosure, nor is it intended to limit the scope of any claims.

BRIEF DESCRIPTION OF THE DRAWING

A more complete understanding of the present disclosure may be realized by reference to the accompanying drawing in which.

DETAILED DESCRIPTION

Figure 1:
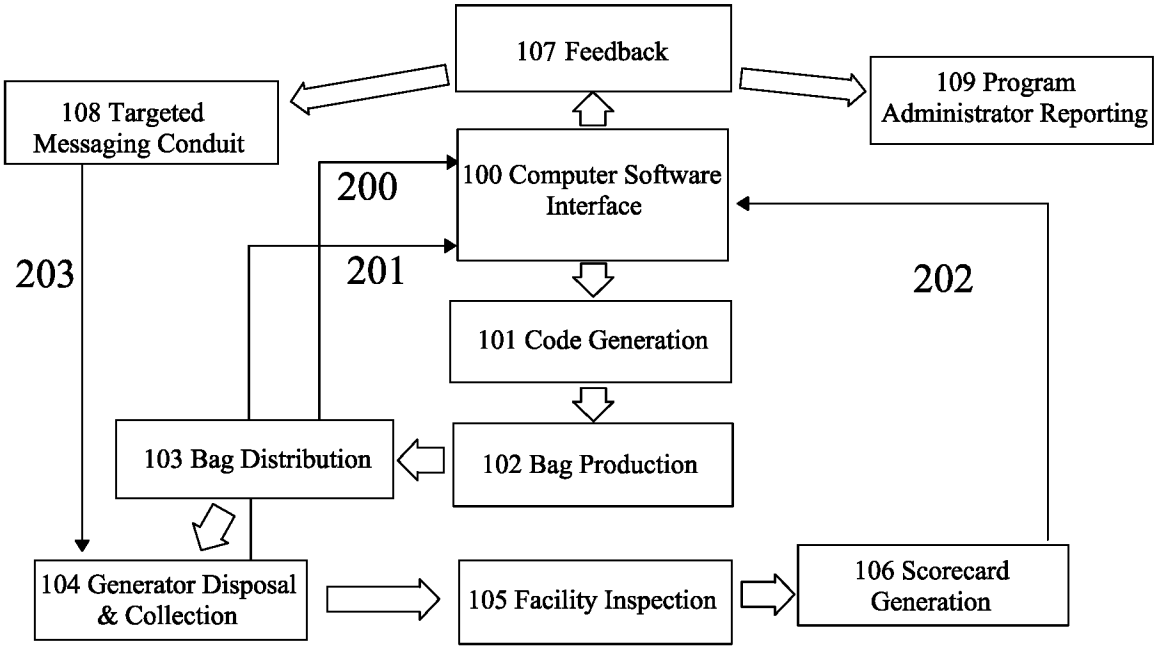
FIG. 1 provides a schematic drawing illustrating a system for manufacturing and tracking materials management bags.

The following merely illustrates the principles of the disclosure. It will thus be appreciated that those skilled in the art will be able to devise various arrangements which, although not explicitly described or shown herein, embody the principles of the disclosure and are included within its spirit and scope.

Furthermore, all examples and conditional language recited herein are principally intended expressly to be only for pedagogical purposes to aid the reader in understanding the principles of the disclosure and the concepts contributed by the inventor(s) to furthering the art, and are to be construed as being without limitation to such specifically recited examples and conditions.

Moreover, all statements herein reciting principles, aspects, and embodiments of the disclosure, as well as specific examples thereof, are intended to encompass both structural and functional equivalents thereof. Additionally, it is intended that such equivalents include both currently known equivalents as well as equivalents developed in the future, i.e., any elements later developed that perform the same function, regardless of structure.

Unless otherwise explicitly specified herein, the drawings are not drawn to scale.

Aspects of the present disclosure are directed to system and method for manufacturing and tracking materials management bags.

Within the present disclosure, the following terms are used and defined as follows:

- Attached: placing code(s) on an item, such as a bag, by means of printing, affixing or embedding it.
- Bags: bags, as commonly understood, are used to contain, transport, measure or meter solid waste, trash, garbage, recycling (mixed or disaggregated, by material type), organic material and other material streams Bags may be made of plastic or another suitable material.
- Codes: a number, series of numbers, image, series of images, or a combination of number(s) and image(s), such as a bar code, QR codes, chip or other codes that are intended to identify an individual bag or series of bags and rolls of bags. The term code shall have the same meaning as codes, but shall refer to a singular code, such as when a singular code on a bag is scanned at a facility.
- Facility: a waste disposal facility (landfill, incinerator, waste-to-energy facility or other), recycling facility, reuse facility, compost facility (including open-field composting as well as anaerobic digestion facilities), intermediate processing facility, or other location where materials are disposed of or processed for disposal, reuse or recycling.
- Generator: entities that generate materials to be contained in bags, including individuals, households, commercial and non-profit entities, singularly or acting as a group, such as a multi-family housing development or a complex of commercial entities.
- Inspection: the process of weighting, evaluating, scanning, logging, or characterizing materials within the bags and their contents. This can be done manually, semi-manually or by using automated technology and in a manner that may, but does not require, the bags to be opened.

Goals: the intent a municipality, corporation, non-profit entity or other entity seeks to achieve in using this invention, including the reduction of waste that must be disposed of; increasing recycling; increasing organic material diversion; reducing the toxicity of the waste, recycling and organics streams; reduction of greenhouse gasses and other forms of pollution; furtherance of environmental and/or social justice, as defined by the entity; the achievement of financial goals, such as generation or revenue or reduction in costs; or other reasonably-related intents.

Outer Bag Code: the final code on an outermost bag in a roll of bags. When scanned, the Outer Bag Code will be used to associate together all other codes on that roll of Bags to one another. The Outer Bag Code will be associated with a generator who has been assigned to use the roll of bags.

Program Manager: municipalities; waste or recycling haulers; waste, recycling, organics, or reuse entities, including companies; waste reduction entities, including companies; non-profit entities; or governmental entities involved in the management or administration of waste, recycling, organics or other materials management programs.

In accordance with aspects of the present disclosure, an exemplary system for manufacturing and tracking materials management bags is depicted in FIG. 1. The system of FIG. 1 includes the a computer-based tool 100 which is configured to perform four functions including: generation of a database consisting of unique codes 101; receipt of generator identification information (for example, including but not limited to: address, email, cell phone number, or other user information in connection with assigned codes, as depicted in FIG. 1 by information flows 200, 201); receipt of scorecard data related to information learned during bag inspection associated with each particular bag code (depicted in FIG. 1 by, information flow 202); and feedback provided directly to generators and program managers depicted in FIG. 1 by information flow 203). The system elements of FIG. 1 may be further described as follows.

Code Generation 101: The generation of a database of unique codes that are pre-grouped, either sequentially or randomly, and which are associated together with other bags on a bag roll which themselves are linked to each other and are represented by outer bag code 110.

Figure 4:
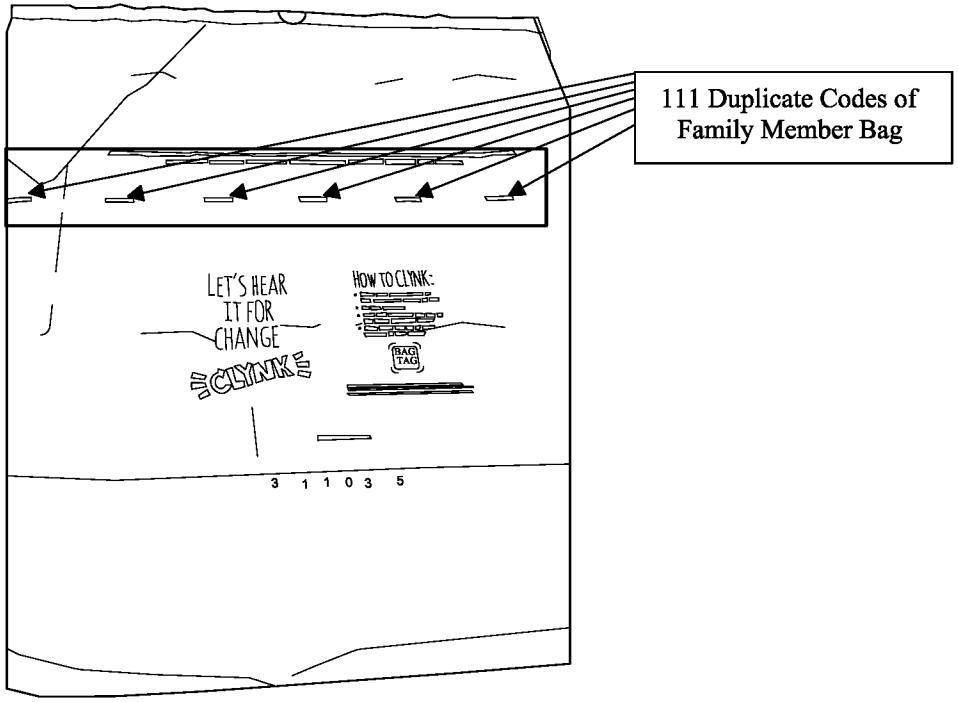
FIG. 4 provides a schematic drawing further illustrating the materials management bag of FIGS. 2 and 3.

Bag Production 102: The production of bags on rolls. Each bag within a roll contains a different unique code to be linked with its outer bag code 110, which is preferably printed or otherwise attached in specific locations on each bag. The outer bag code 110 will be associated with and represent all bag codes 112 on the roll and therefore will represent a different number of bags based on the number of bags on a roll. The codes are attached in locations convenient for use by the facility, program managers, generators and others, with one or more codes located so that they are visible on the outer bag on a roll. The codes are attached, for example as illustrated in FIG. 4, along a bottom of the folded section 114 of the bag which, when folded and rolled, becomes the outer layer of the roll of Bags. The code attached on the right side of the perforation of the last Bag on the roll (or the "tail" 115) becomes the outer bag code 110 for that roll of bags. Advantageously, the outer bag code 110 may remain visible after a paper, plastic or other packaging wrapper 117 is added to secure and label the roll. Thus, the outer bag code is the "matriarch" of the "family of Bags" within each roll. For example, a roll of 10 bags may have 10 unique codes 112 (one for each bag). Each individual bag may have its code affixed in more than one location 111, and each of the unique codes 112 may be associated with ("tied to") the outer bag code 110. The outer bag code 110 is important for two reasons: when it is recognized or scanned, and activated, it automatically associates all of the bags 112 within a roll to each other and to a specific generator. When the outer bag code 110 is scanned during the manufacturing and packing process, it automatically associates all bag codes 112 within the roll to each other and also to all the other rolls within an associated master packing case 113. This scheme is helpful in-order-to prevent or identify bag counterfeiting and, for manufacturers of bags and other items, to enhance quality control and inventory counting, management and control. It should also be noted that each outer bag code 110 can also be associated with the master packing case code 113.

Bag Distribution and Generator Identification 103, 200; The coded bags are provided to and linked to a generator, and are used by the generator to hold waste, recycling, organic and other materials. Generators may obtain bags for example through municipal distribution programs (voucher, mailing or municipal delivery) such as in Columbia MO; through designated retailers or municipal offices as in pay as you throw ("PAYT") programs in municipalities like Worcester, MA; through vending systems; via online sales and/or distribution; from a waste reduction or hauling company; or through other program managers. The addresses or identities 200 of the Generators may be acquired either through these distribution systems, or through generator self identification through online, mobile application, in person, third party assistance or other means. Once acquired, the generator identity is then connected by bag tracking tool 100 to a specific outer bag code 110 which in turn links to all codes 112 within the roll of bags and to the master packing case code 113 for the case that contains the bag roll. This allows problems with an individual bag, for example, to be traced to a store or other entity that distributed the bag to the generator in order to address any distribution problems. As an example, in a municipal bag mailing, the outer bag code 110 would be activated or scanned and then connected with a specific generator address prior to being mailed. In a multifamily program or commercial entity, the code on the case of bags 113 could for example be scanned and associated with an apartment complex or management company, or broken down further to be linked to an individual apartment within a building, allowing the associated generator (the multifamily property) to be known without scanning the outer bag code 110 on each roll of bags.

Generator Disposal and Collection 104: Bags are filled by the generator with recycling, compost, or other materials. The Bags are placed out for collection, either loose or in carts, barrels, dumpsters, or similar storage devices, where they are picked up by a truck along with other bags and materials. Bags may be collected through automated, semi-automated or manual collection. The collection protocol for program managers may vary and provide additional mechanisms or ways to capture and link generator identities 201 to a code 112 and/or verify program compliance 201. During collection, the collection worker, collection vehicle or others can for example obtain and link generator identification 200 by identifying the Code and geolocating the address via GPS, codes on carts, barrels, dumpsters or other similar storage devices, or through other means. This may also permit the association of codes with generator identification information acquired by collection personnel, collection vehicles or other using already-existing technology. This information may be captured, logged, communicated, and associated manually or electronically, including in an automated manner from collection vehicles 201 so that feedback related to proper bag use is easily sent directly to Generator in an automated or other manner.

Facility Inspection 105: After collection, the bags then arrive at a facility where they are inspected for example to gain information about their contents, either by hand or automated systems, such as conveyor belts with automated scanners. During inspection, the code on the bags may be read and the contents within the bag may be assessed manually or by using an appropriate technology including artificial intelligence, scanning, bio-metric scanning, imaging, laser, camera or other technology. Attaching one code multiple times on a single bag 111 provides the advantage of creating redundancy in case one or more of the codes is not clearly readable individually. Additionally printing the code on both sides of the bag allows for the bag codes to be read regardless of how they are placed on a conveying system. As an example, in an automated inspection process, the bag may move along a conveyor and be scanned by tubular scanner, imager, biometric scanner or other device, including handheld devices, to identify the code, conduct the inspection and establish bag weight and other evaluation factors.

Scorecard Analysis 106: The inspection may preferably be used to generate an information scorecard about the material in individual bags, including but not limited to factors including weight, material composition, quality and compliance with program rules and requirements. The specific scorecard for each bag may be captured by a facility and loaded into the bag tracking tool ("database tool") 100 for use by the program manager as illustrated by information flow 202 of FIG. 1.

Feedback Generation 107: The database tool 100 matches a bag code and its scorecard to the specific generator, and facilitates feedback to the generator, to the program manager and to the collection worker and/or vehicle. Feedback to the generator may include education and/or fines penalties. If inspection determines that bag use is compliant with program rules, such as lack of contamination, the generator may be incentivized or rewarded. Additional feedback to collection workers and vehicles may permit these entities to administer the non-collection of bags or the distribution of educational material to generators who have previously been identified as non-compliant with program rules.

Messaging Conduit 108: The feedback loop to the generator may be provided automatically through the database tool 100 by the tool 100 triggering a message through a targeted messaging conduit, for example, including: mail, email, text messaging, a mobile application, a notification system, or a combination of these conduits. Feedback may also be provided via the program manager, collection workers or collection vehicles.

Program Manager Reporting 109: The bag code tracking tool 100 may provide program managers with multifaceted materials management information analyzed by generator and/or generator location (for example, by aggregating generators into their physical neighborhoods or materials collection routes), collection route, materials type (for example, examining whether generators on a particular route on an organics collection day are generating too much contamination), and others, including specific program compliance factors (for example, specific mandatory recycling laws by municipality). Upon Inspection, if the Bags are non-compliant (for example, containing recyclable materials that should have been separated out), non-compliance may be noted during inspection and be reflected in the bag scorecard. This scorecard information may be loaded into the database of database tool 100 and matched with the generator. Feedback may then be provided to the generator to help improve materials management including recycling, composting, reuse, or waste reduction. If inspection indicated that the bags were compliant with program rules (for example, trash bags having with no recyclables present), the generator may be incentivized or rewarded for their behavior. The feedback loop to the generator can be automatic through the database tool 100 that triggers a message through mail, email, text message, a mobile application, or a combination of the above. Feedback may also occur through the program manager, collection worker, collection vehicle, or through another notification system. As further example, if a municipality experiences contamination in its recycling, this database tool 100 could be queried to identify where contamination is occurring and tailor outreach, education, rewards, and enforcement to the specific generators who are creating the contamination. The bag code tracking tool 100 can provide multifaceted materials management information by generator, material category, neighborhood, street, and other characteristics to support these and other efforts.

In summary the bag tracking and database tool 100 depicted in FIG. 1 is configured to create and store a unique series of codes 101 which are attached to rolls of bags 102; interfaces with program managers to receive the identity of generators that have received bags with codes 101 during the distribution 103 or collection 104; interfaces with collection 104 and inspection 105 processes to receive inspection scorecard information 106 related to specific bag codes; and sends or facilities targeted messages 107, 108 to generators in the form of education, penalties or incentives 108 as well as reports to the Program Managers 109.

In accordance with additional aspects of the disclosure, FIGS. 2-6 illustrate an exemplary bag and bag roll produced by the bag production element 102 depicted in FIG. 1. As illustrated for example in FIGS. 2-4 and 6, the bags 102 forming a bag roll each include a unique family member code 112, that is preferably printed or fastened to the bag together with duplicate codes 111 that provide information redundant in case one or more of the codes 111, 112 is illegible or otherwise not readable during conduct of a manual or automatic code scanning process. Each family member code 112 is unique, and the codes 112 provided to bags in an individual bag roll may include alphanumeric or numeric strings that are assigned in an ordered sequence, or more preferably, in a random sequence. Bag rolls with code strings assigned in a random sequence provide the advantage of being difficult to counterfeit.

Figure 2:
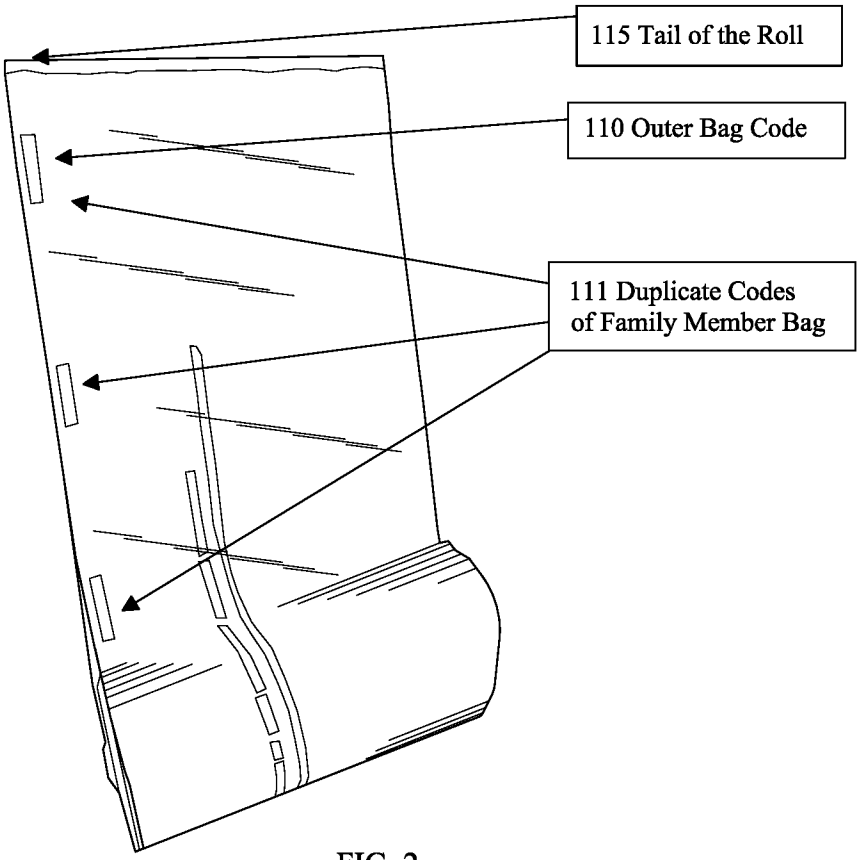
FIG. 2 provides a schematic drawing depicting an exemplary materials management bag produced and used by the system of FIG. 1.
Figure 3:
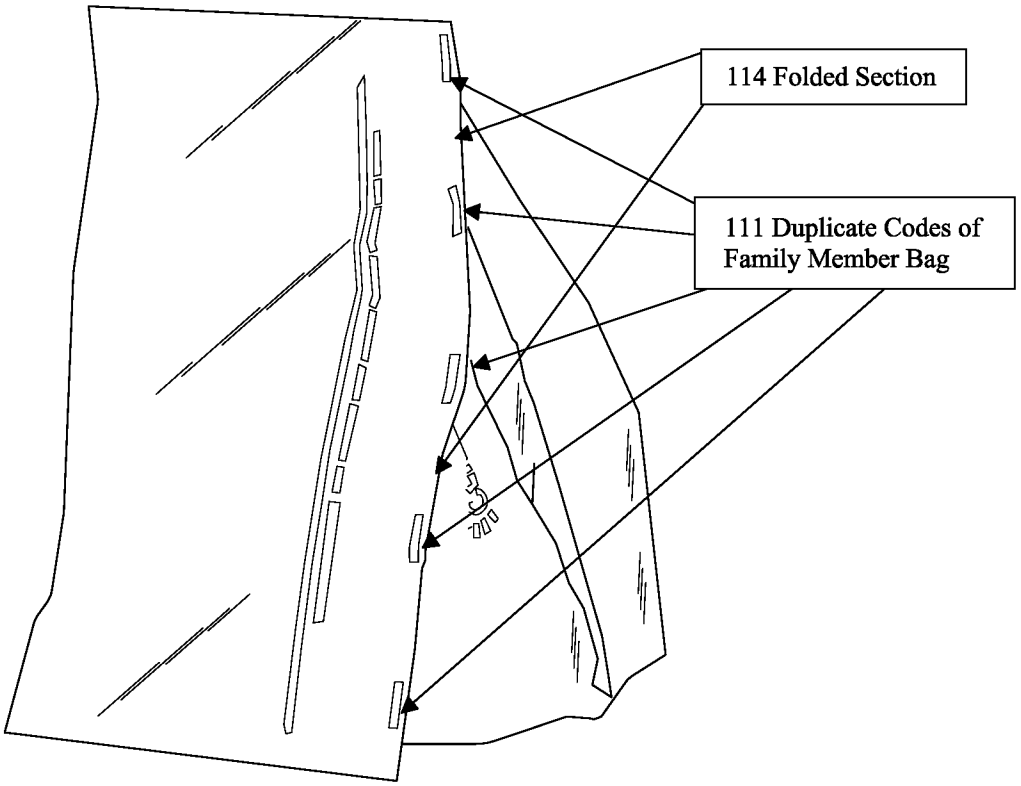
FIG. 3 provides a schematic drawing further illustrating the materials management bag of FIG. 2.
Figure 5:
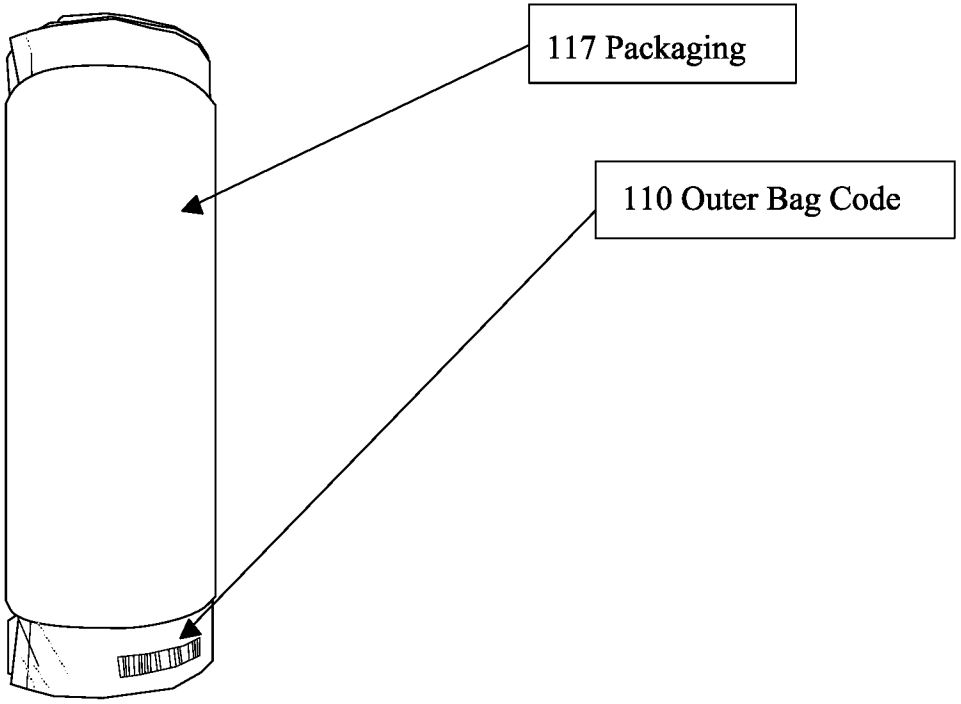
FIG. 5 provides a schematic drawing depicting a bag roll having multiple bags of a type depicted by FIGS. 2-4.
Figure 6:
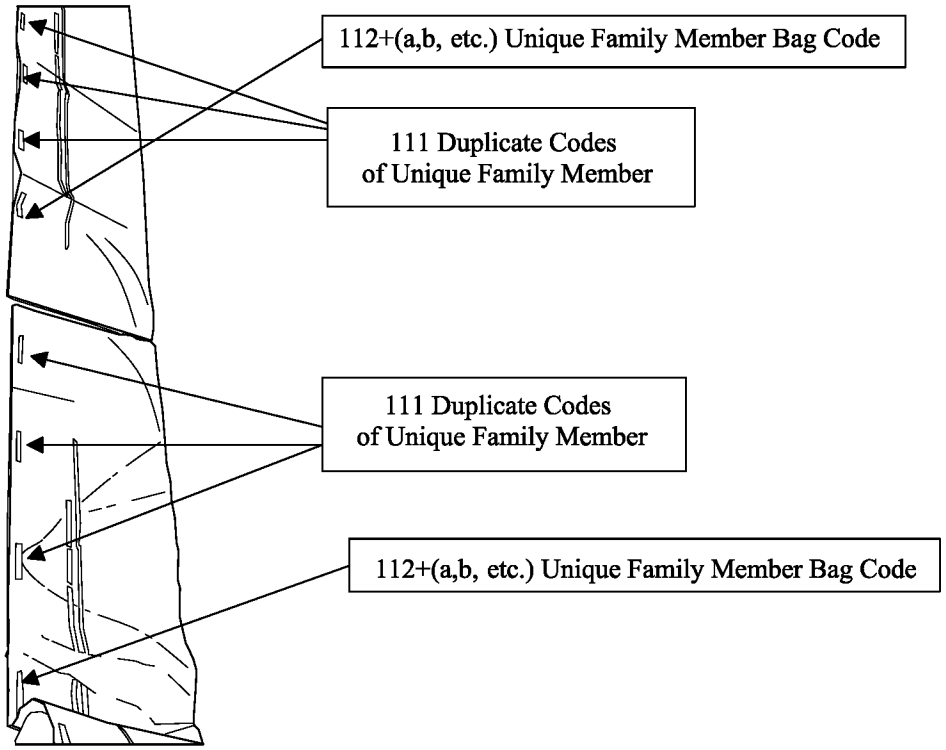
FIG. 6 provides a schematic drawing illustrating bags in the bag roll of FIG. 5.

As illustrated for example in FIG. 4, duplicate codes 111 of a family member bag are linearly spaced horizontally in a window that crossed the family member bag. With reference to FIGS. 2 and 3, it can be seen that the duplicate codes 111 are positioned along a folded section 114 which is created during the bag manufacturing process to facilitate the production of a compact bag roll. An advantage of this feature of the bag production process can be seen with respect to FIG. 5, Which illustrates a bag roll further fitted with an opaque packaging wrapper 117 (packaging wrapper 117 may in fact be formed from a variety of opaque, translucent materials suitable for securing the bag roll, including paper and plastic film). As illustrated in FIG. 5, by positioning the family member code 112 and duplicate codes 111 along the fold line 114, these codes can be maintained in a visible state at an edge of the bag roll when the bag is the outermost bag on the roll. For this reason, and with reference to FIGS. 5 and 7, the family member bag code 112 of the bag that is outermost at the time that the bag roll is produced is identified as outer bag code 110, and is used by the bag tracking tool 100 as a key to identify the family member bag codes 112 for each of the bags in the bag roll. As illustrate in FIG. 2, outer bag code 110 can be identified during the bag roll production process as the code 112 that is adjacent to the tail of the roll 115.

Figure 7:
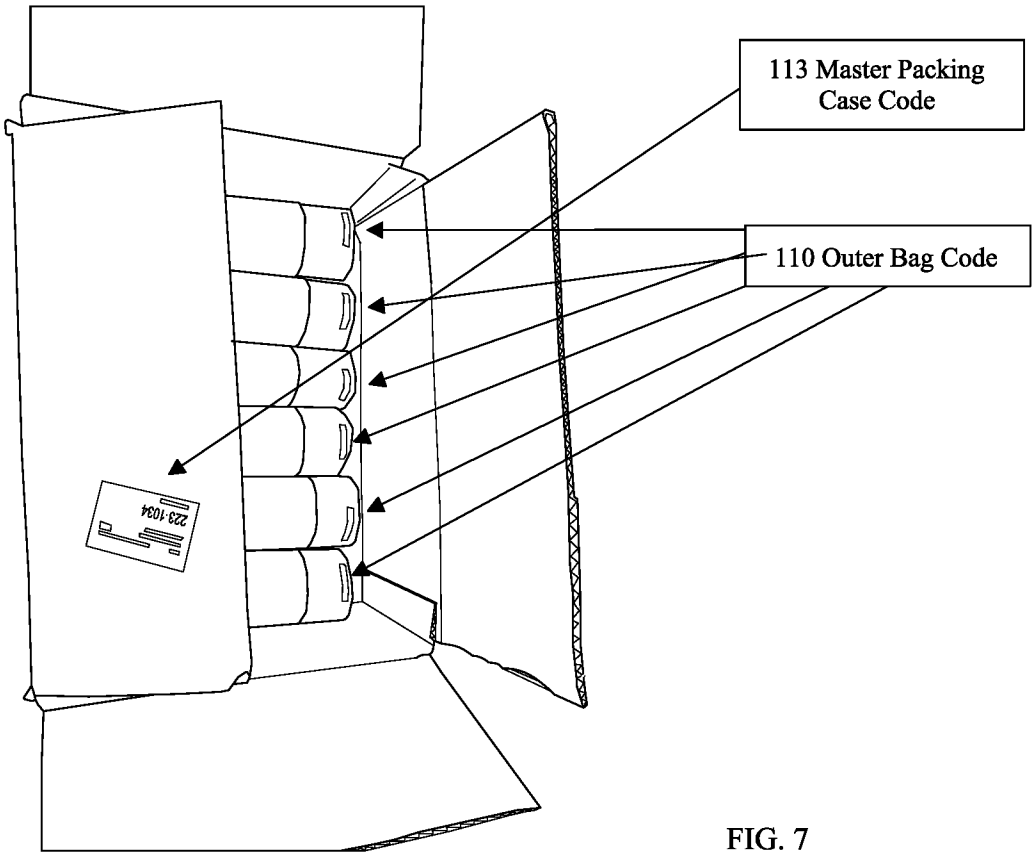
FIG. 7 provides a schematic drawing illustrating a case folding multiple ones of the bag rolls of FIG. 5.

In accordance with other aspects of the disclosure, and by way of example, FIG. 7 illustrates a master packing case for packing six bag rolls together for transport (for example, to an apartment complex, commercial entity or management company). As illustrated, the outer bag code 110 of each of the bag rolls is visible in the unsealed master packing case, and a master packing case code 113 has been applied to the master packing case. In this configuration, each of the codes 110, 113 can be scanned and provided to the bag tracking tool 100, and the scanned outer bag codes 110 of the bag rolls can be associated with the master packing case code by the bag tracking tool 100. Further, prior to shipment to the apartment complex, commercial entity or other location, the bag tracking tool 100 can associate the master packing case code 113 to the shipment location thus linking this roll and each bag to a specific end user.

Figure 8:
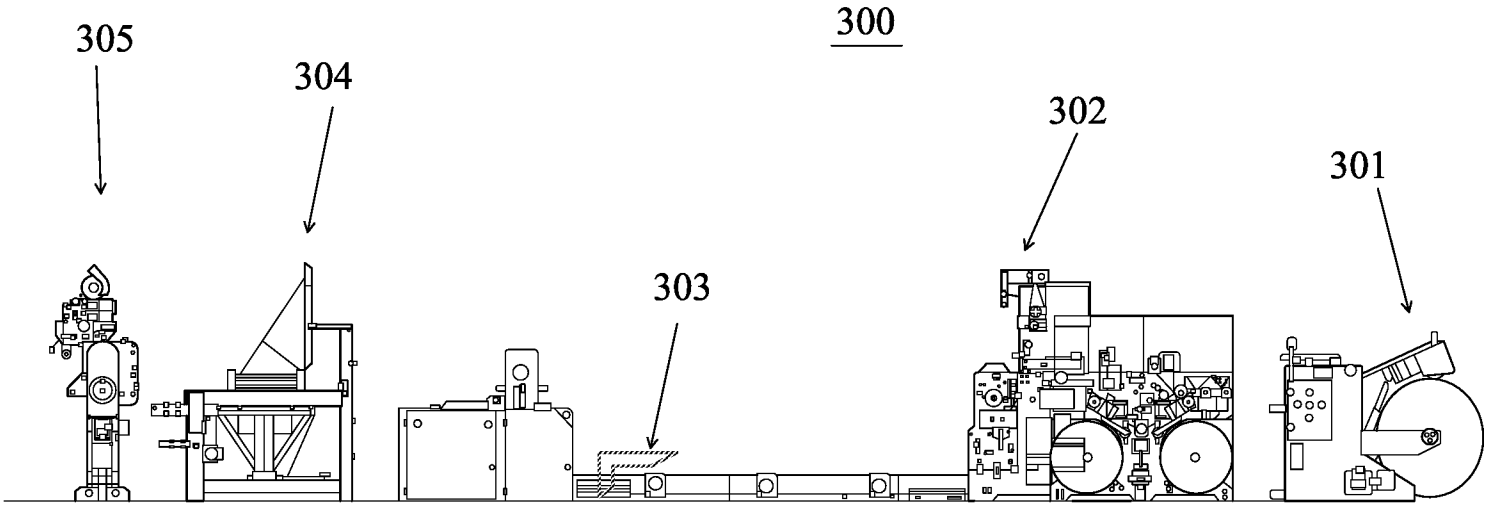
FIG. 8 provides a schematic drawing illustrating a system for manufacturing the bag rolls of FIG. 5.
Figure 9:
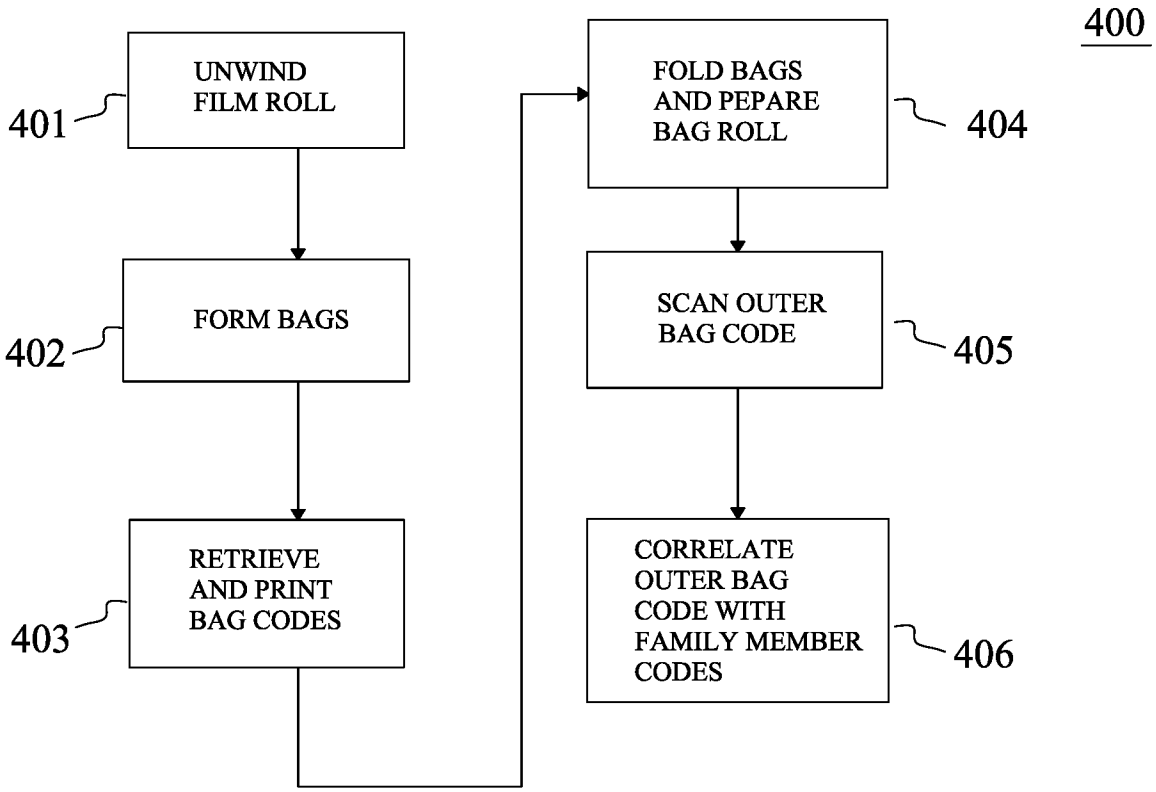
FIG. 9 provides a flow diagram illustrating a method for making the bag rolls of FIG. 5 using the system of FIG. 8.

In accordance with further aspects of the disclosure, FIG. 8 illustrates a production system 300 for producing the bag rolls, and FIG. 9 provides a process flow diagram for a method 400 of producing the bag rolls using the system 300 of FIG. 8. With reference to FIG. 9, the process begins at step 401 with the unwinding of plastic film from a film roll at film roll unwinder 301 of FIG. 8. At step 402, bags are formed for the bag roll by bag forming machine 302 of FIG. 8, For example, bag forming machine 302 may form side and/or bottom edges of each bag by heat sealing, and apply a cutter to form perforations 115 for later separating adjacent bags in the bag roll from one another. At step 403, code printer 303 receives code information for the family member code 112 of each manufactured bag, and prints the family member code 112 and duplicate codes 111 at predetermined locations on the bag surface. It is possible to fix the code printer 403 before or after the bag forming 402 step. At step 404, bag folder and roller device 304 of FIG. 8 folds the bags in a manner that leaves codes exposed (so that they may be scanned) and in preparation for forming the bag roll, and then forms the bag roll. Folding depends on the size of the bags, as different size bags require different folding to ensure codes will remain visible.

At step 405, scanner 305 of FIG. 8 scans the outer bag 110 (which is visible on the outer surface of the bag roll as the family member code 112 for the last bag in the roll), and communicates with bag tracking tool 100 at step 406 in order to correlate the outer bag code 110 with the family member codes for the other bags in the bag roll. The bag tracking tool 100 as well as the printing and scanning processes can be utilized with commonly made equipment including Coemptor and Roll-o-Matic machinery.

In summary, the following aspects of the present disclosure are highlighted:

1. The bag tracking tool 100 may be implemented as a general-purpose computer or computer server including or otherwise having access to a database of interconnected codes which are attached to bags within a bag roll in a sequential or random order and act as a tool to track bagged material back to a specific generator in-order-to provide feedback to the generator in the form of education, incentives, or penalty or to the program manager.
2. The outer bag code 110, when activated or scanned for the bag tracking tool 100, may identify all other codes on that roll of bags.
3. The outer bag code 110 may be strategically attached to the last bag of the roll so that it is facing out and on the edge of the fold 114 or perforation 115 when the bags are folded and rolled, so it is visible after the wrapper 117 is applied, so that the outer bag code 110 can be easily scanned into the system during packing and/or by an individual, including via mobile application or during distribution 103.
4. All family member codes 112 within a roll may be associated to each other, so that when any bag is activated or scanned, all other bags on that roll will be known to the system as part of that roll. All outer bag codes 110 of a roll of bags may be scanned into a system prior to packing into an outer case during the manufacturing process, with all rolls and all codes attached to bags on each of those rolls connected to master packing case code 113. This will allow the system to know which rolls are within which case and will allow the scanning of a case to automatically identify its contents. This will enable improved inventory management, automated roll counting in each case, improved quality assurance of manufactured products, traceability as to which cases are shipped to which stores, traceability to end users and other functionality, including the application of rewards, user education and others,
5. Unique sequential or random codes may be attached to bags in groups based on the number of bags on a roll in a random or sequential order.
6. A program manager may issue bags with codes to generators through distribution, purchase, or registration and upload identification information of a generator. The generator identification is associated with the outer bag code 110 of each bag roll. Identification information can be obtained from a variety of methods, including mailing addresses during bag distribution, identification through voucher systems, generator registration, and the like.
7. Generator information may also be captured during bag collection and transmitted to the bag tracking tool 100.
8. The bag tracking tool 100 may be configured to receive and analyze scorecard information from a facility based on inspection of coded bags, and provide feedback to Generators, either directly through the tool 100 or through other means, informed by the tool 100. This feedback may be provided to program managers, employees, volunteers and others using tool information. The timing of feedback may for example be based on program managers' parameters (for example, monthly) based on the scorecard for coded bags. Feedback may also be based on program manager parameters and include incentives such as tax breaks for positive behavior, fines for negative behavior, and/or education messages based on specific information related to the scorecard for individual bags generated by individual generators.
9. Bags may have one or multiple unique codes strategically attached in an area convenient to allow manual or automated identification of the bag code. Attachment of unique duplicate codes 111 on a bag create redundancy in case one or more of the codes is not clearly readable during the identification or inspection process, due to smudged ink or if the bag is wrinkled.

10. Use of randomized unique codes for each hag may help prevent fraud. With unique codes, counterfeit bags could not be added to the system without being easily identified as counterfeit. If counterfeit bags are found, the code on the counterfeit bag may be usable to identify the original generator and recipient of the case of bags or bag roll, which may be helpful to track the origin of the counterfeiting.

It will be understood that, while various aspects of the present disclosure have been illustrated and described by way of example, the invention claimed herein is not limited thereto, but may be otherwise variously embodied within the scope of the following claims. For example, while the present disclosure describes a manufacturing process in which duplicate codes 111 are printed on materials management bags, an alternate embodiment of the manufacturing process might incorporate a mechanism for applying the duplicate codes 111 in the form of adhesively-applied labels.

The following table lists the reference characters and names of features and elements used herein: Reference characters assigned to method steps are not listed.

| Ref. char. | Feature or element |
|---|---|
| 100 | Bag tracking tool |
| 110 | Outer bag code |
| 111 | Duplicate code |
| 112 | Family member code |
| 113 | Master packing case code |
| 114 | Folded section |
| 115 | Tail |
| 117 | Wrapper |
| 300 | Bag manufacturing system |
| 301 | Film roll unwinder |
| 302 | Bag former |
| 303 | Code printer |
| 304 | Bag folder and roller |
| 305 | Outer bag code scanner |

We claim:

1. A method of making a bag roll by a bag forming machine in communication with a computer-based database tool, the bag roll including a plurality of bags, the bag forming machine carrying out the steps of:

forming a continuous sequence of bags for inclusion in the bag roll;

communicating with the computer-based database tool to obtain a plurality of unique identifying codes, each unique identifying code obtained to be associated with a respective one of the bags in the continuous sequence of bags;

printing, affixing, or embedding at least one instance of each identifying code to its respective bag in the continuous sequence of bags;

forming the bag roll from the bags in the continuous sequence of bags having the unique identifying codes;

scanning the at least one instance of the unique identifying code for an outermost bag in the bag roll; and communicating with the computer-based database tool to provide the unique identifying code for the outermost bag to the computer-based database tool and correlate the unique identifying code for the outermost bag with the unique identifying codes for each bag in the continuous sequence of bags included in the bag roll.

2. The method of claim 1, further comprising the step of applying a wrapper to maintain the plurality of bags in the bag roll.

3. The method of claim 2, further comprising the steps of:

associating the bag roll with a container configured for receiving the bag roll and at least one more bag roll, the at least one more bag roll having another unique identifying code for an outermost bag of the at least one more bag roll;

communicating with the computer-based database tool to provide the unique identifying codes for the outermost bags of the bag rolls and obtain a container code for the container, whereby the computer-based database tool is operative to store and associate the unique identifying codes for the outermost bags of the bag rolls with the container code.

4. The method of claim 3, further comprising the step of printing or affixing the container code to the container.

5. The method of claim 1, wherein, the identifying codes are selected from the group consisting of numbers, alphanumeric strings, images, and combinations of numbers and images.

6. The method of claim 5, wherein the identifying codes are selected from the group consisting of barcodes, matrix barcodes, QR codes, and chip codes.

7. The method of claim 5, wherein the identifying codes include or indicate numbers or alphanumeric strings arranged in a sequence matching the sequence of the plurality of bags in the bag roll.

8. The method of claim 7, wherein the numbers or alphanumeric strings are successively sequential.

9. The method of claim 7, wherein the numbers or alphanumeric strings are randomly selected and arranged.

10. The method of claim 1, wherein the continuous sequence of bags is formed from a flattened plastic film.

11. The method of claim 1, wherein the computer-based database tool, upon initially identifying an association of one of the bags in the bag roll to an entity, is further operative to associate all of the bags in the bag roll with the entity.

12. The method of claim 11, wherein the computer-based database tool initially identifies the entity as associated with the identifying code for the outermost bag in the bag roll.

13. The method of claim 11, wherein:

the plurality of bags in the bag roll are configured for use in materials management or material recovery, and the entity is a generator of materials for management or recovery.

14. The method of claim 13, wherein the entity is selected from the group consisting of apartment buildings, commercial buildings, multi-family houses, single-family houses, property management companies, commercial entities non-profit entities, households, and individuals.

* * * * *